United States Patent [19]

Cembruch et al.

[11] Patent Number: 4,693,688

[45] Date of Patent: Sep. 15, 1987

[54] GROUNDING CONNECTOR

[75] Inventors: Bronislau J. Cembruch, Havertown; Walter M. Werner, Downington, both of Pa.

[73] Assignee: AMP Incorporated, Harrisburg, Pa.

[21] Appl. No.: 885,065

[22] Filed: Jul. 14, 1986

[51] Int. Cl.[4] ..... H01R 4/10

[52] U.S. Cl. ..... 439/877; 439/101

[58] Field of Search ..... 339/14 R, 275 RB, 276 R, 339/276 RB, 14 L, 221 R

[56] References Cited

U.S. PATENT DOCUMENTS

| | | | |
|---|---|---|---|
| 2,155,217 | 4/1939 | Bovard | 339/275 RB X |
| 2,725,615 | 12/1955 | Edwards | 339/276 RB X |
| 2,741,752 | 4/1956 | Edwards | 339/276 RB |
| 4,114,262 | 9/1978 | Franck | 339/276 RB X |

*Primary Examiner*—Eugene F. Desmond

*Attorney, Agent, or Firm*—Allan B. Osborne

[57] ABSTRACT

A grounding connector for use in grounding a rail or other structure, more particularly the connector includes a terminal to which a grounding cable can be attached and a rod secured to the terminal having a tapered pin for driving into a hole in the rail or other structure.

5 Claims, 4 Drawing Figures

GROUNDING CONNECTOR

FIELD OF THE INVENTION

The present invention relates to connectors used for attaching a grounding cable to railroad tracks and other structures subjected to environmental conditions, vibrations and other stresses.

BACKGROUND OF THE INVENTION

Users of the prior art grounding connector must have a semi-permanent graphite mold vessel with suitable clamps, weld material which is a mixture of copper oxide and aluminum and a ignitable starting material. The user places a grounding pin and the grounding cable, both of which must be clean, dry and not deformed, into the weld cavity of the mold vessel which also must be clean, dry and in good condition. The mold vessel is closed and a steel disk placed in the crucible over the tap hole leading to the weld cavity. The weld material is dumped into the crucible over the steel dish and the starting material sprinkled thereover and on a lip leading to the crucible. After the cover is placed over the crucible, the starting material and hence the weld material is ignited by means of a flint lighter. The exothermic reaction produces molten copper and aluminum oxide slag with the molten copper flowing down the tap hole (the steel dish being dislocated by the copper) and over the cable and pin, melting and welding them together.

Although the above described method provides a satisfactory ground connector, the user must have trained personnel to use the method, smoke which is released from the burning may be hazardous and breathing thereof should be avoided, the mold becomes hot and must not be touched until cooled, fire hazards in the immediate area of the mold must be removed and the person performing the operation must not have burning or smoking; e.g. cigarettes, items near-by when handling the starting material. In addition to the above disadvantages, the mold vessel has a limited life of about fifty operations.

It is now proposed to provide a grounding connector which the user needs only to crimp onto the grounding cable and then secure to the rail or other structure to be grounded.

SUMMARY OF THE INVENTION

According to the present invention, a grounding connector is provided having a terminal to which a grounding cable can be attached and a rod, secured to the terminal, having a tapered pin to be driven into a hole in a rail or other structure being grounded.

DESCRIPTION OF THE INVENTION

Figure 1:
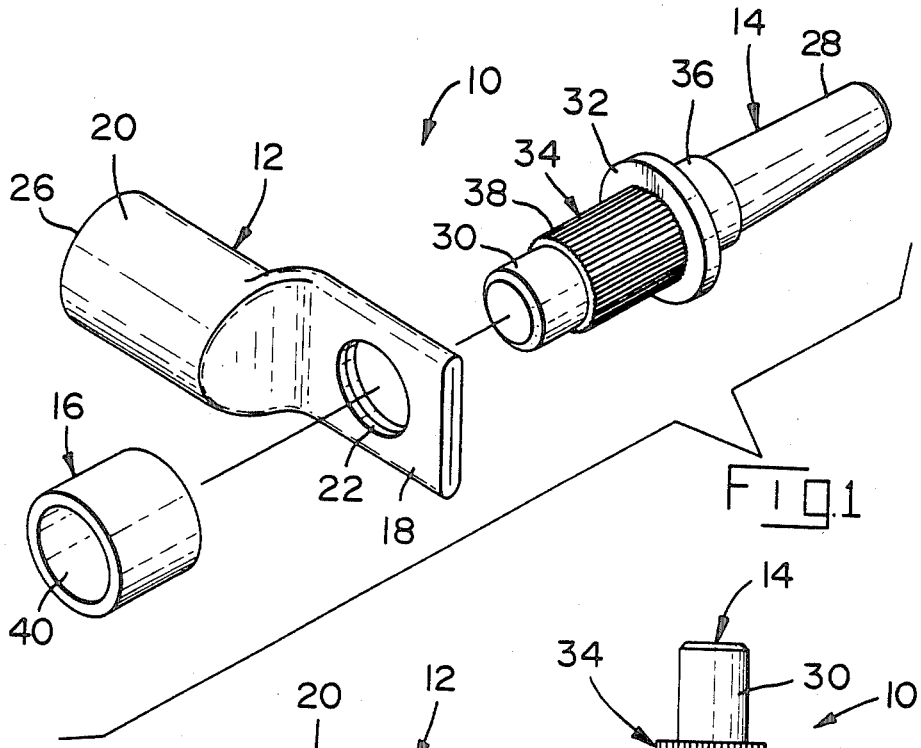
FIG. 1 is an exploded perspective view of the grounding connector of the present invention.

As shown in FIG. 1, the components of grounding connector 10 include terminal 12, rod 14 and locking collar 16.

Terminal 12 comprises a rectangular tongue 18 at one end and cable receiving barrel 20 at the other end. Hole 22 is provided in tongue 18. As shown in phantom in FIG. 2, aperture 24 is provided in barrel 20 with opening 26 thereto being at the back end of terminal 12.

Terminal 12 is formed from a heavy copper tube (not shown) and preferably plated with tin. Tongue 18 is formed by flattening one end of the tube and hole 22 is drilled through the flattened end.

Rod 14 includes tapered pin 28 at one end, driving head 30 at another end and annular flange 32 intermediate the ends. Further included are knurled portion 34, located between driving head 30 and flange 32, and upset portion 36 located between pin 28 and flange 32. Knurled portion 34 has a diameter greater than head 30 and hole 22 on terminal tongue 18 with knurl 38 thereon being coarse and extending axially therealong. Rod 14 is preferably made from steel.

Locking collar 16 is also preferably made from steel. Bore 40 extending therethrough is smooth and has a diameter less than knurled portion 34 of rod 14. As shown in phantom in FIG. 4, one opening to bore 40 is funnel shaped as indicated by reference numeral 42.

Figure 2:
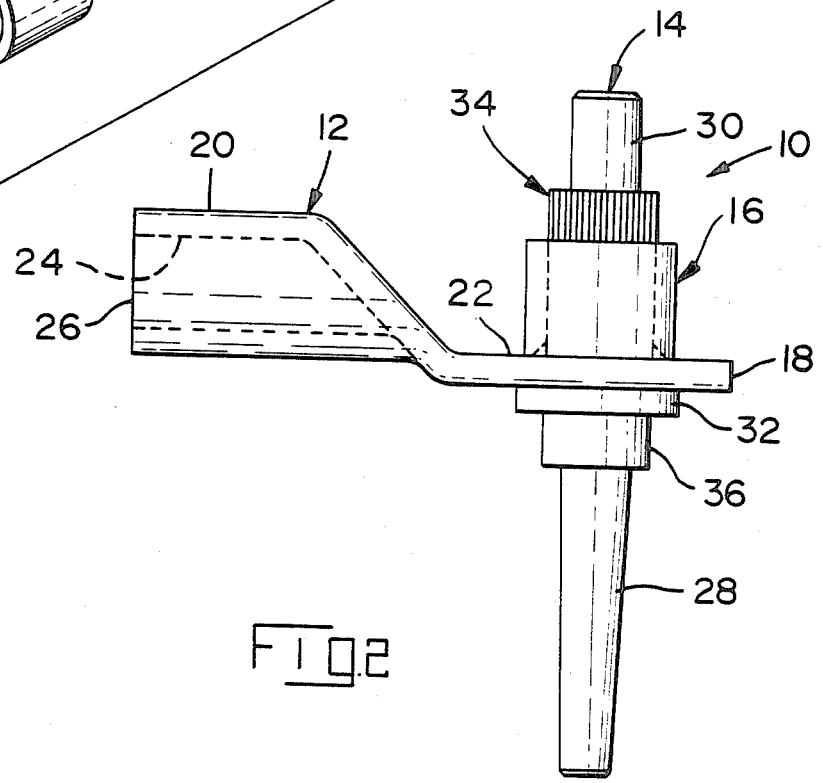
FIG. 2 is a side view of an assembled grounding connector.

FIG. 2 shows an assembled grounding connector 10. In the assembly thereof, terminal 12 is pressed onto rod 14 with knurled portion 34 being received in hole 22 in a very tight interference fit. With funnel opening 42 leading, collar 16 is then pressed onto knurled portion 34 with portion 34 being received in bore 40 also in a very tight interference fit. As shown, tongue 18 is tightly secured between collar 16 and flange 32. The driving of tongue 18 and collar 16 along knurled portion 34 breaks down any oxide formation and removes any foreign matter thereby forming an excellent connection between rod 14 and terminal 12.

Grounding connector 10 is supplied to the user in the assembled condition as shown in FIG. 2.

Figure 3:
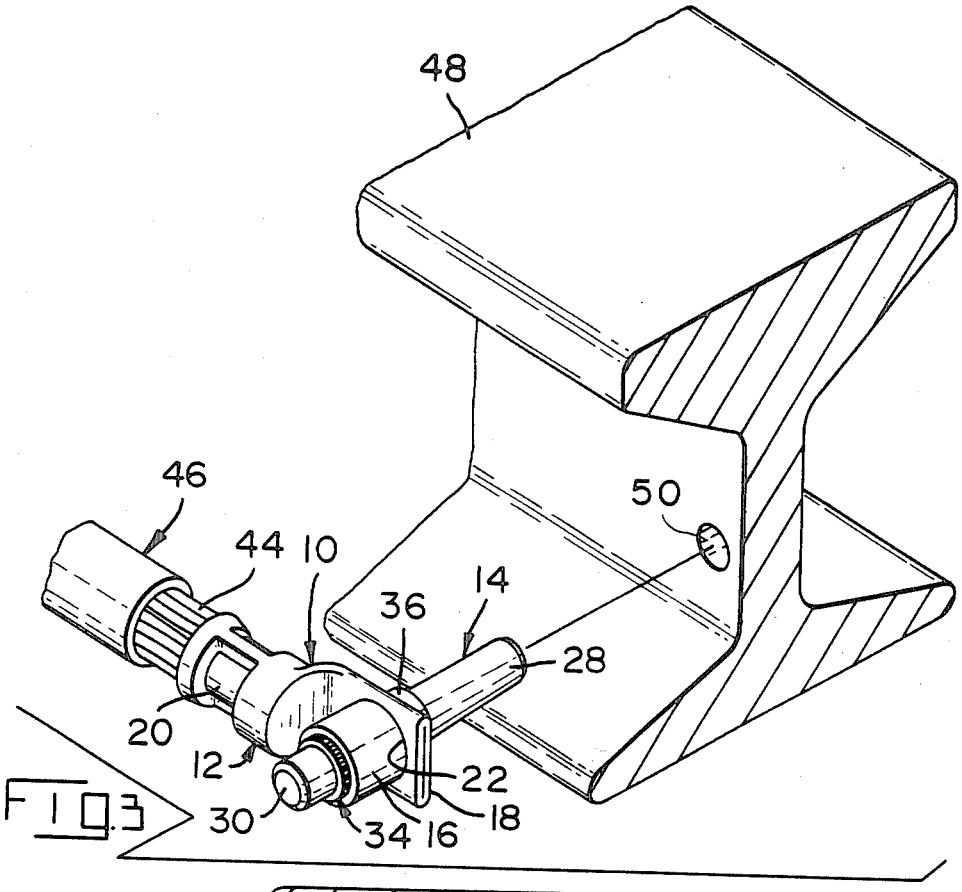
FIG. 3 is a perspective view of a grounding cable crimped to the grounding connector preparatory to being secured to a rail.

FIG. 3 shows grounding connector 10 with bared end 44 of grounding cable 46 placed in aperture 24 of barrel 20 of terminal 12 and secured therein by crimping barrel 20 therearound using a conventional crimping tool in a well known manner. Also shown is a section of rail 48 having tapered hole 50 therein. Alternatively, cable 46 can be secured in barrel 20 by soldering if desired.

Figure 4:
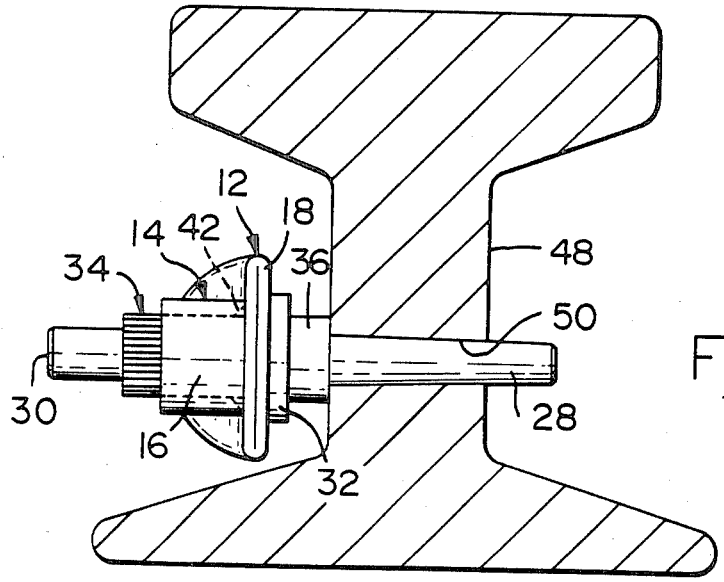
FIG. 4 is a side partly-sectioned view showing the grounding connector secured in the rail.

FIG. 4 is a view showing grounding connector 10 secured to rail 48 by driving tapered pin 28 into tapered hole 50. The driving is simply accomplished by striking driving head 30 with a suitable sized hammer until upset portion 36 abutts rail 48. The driving of pin 28 into hole 50 breaks down any oxide formation and removes any foreign matter thereby forming an excellent electrical connection between rail 48 and connector 10. Grounding cable 46 (not shown) extends from grounding connector 10 to a suitable ground (not shown) to complete the grounding of rail 48.

As can be discerned, a one piece grounding connector has been disclosed which includes a terminal to which a grounding cable can be attached by crimping and a rod having a tapered pin which can be hammered into a suitable hole in a rail or other structure. The rod is secured to the terminal by a knurled portion thereon being forced through a hole in the tongue of the terminal. A locking collar, pressed onto the knurled portion over the tongue provides additional security to the assembly. The end of the rod opposite the tapered pin includes a head to hammer against in driving the pin into the hole.

We claim:

1. A grounding connector for use in grounding a rail or other structure having a hole therein, said connector comprising:

conductive terminal means having receiving means at one end for receiving a grounding cable and apertured tongue means at another end; and elongated conductive rod means having tapered pin means at one end for being driven into the hole in the rail or other structure and securing means adjacent another end for securing said terminal means to said rod means, said securing means including a knurled portion thereon for being received in said aperture in said tongue means, further including collar means for being pressed onto said knurled portion over said tongue means to lock said rod means to said terminal means.

2. The grounding connector of claim 1 further including flange means on said rod means adjacent said knurled portion and against which said tongue means abuts.

3. The grounding connector of claim 2 further including a driving head at an end of said rod means adjacent said knurled portion for being struck to drive said tapered pin into the hole in the rail or other structure.

4. The grounding connector of claim 3 further including an upset portion between said tapered pin and said flange for limiting the depth of penetration of said tapered pin into the hole in the rail or other structure.

5. A grounding connector for grounding a rail, comprising:

a terminal having a tongue and a conductor-terminating section, said tongue having a hole therethrough;

a rod having a pin section and a knurled section slightly larger in diameter than the hole in said tongue;

collar means having a diameter slightly smaller than said knurled section, said collar means being pressed onto said knurled section along with said tongue thereby securing said tongue onto said knurled section; and means provided by said rod for engagement by a driving member for driving said pin section into a hole of the rail.

* * * * *